US006688235B2

(12) United States Patent
Rajaram

(10) Patent No.: US 6,688,235 B2
(45) Date of Patent: Feb. 10, 2004

(54) SUSPENDED COACH TRANSPORTATION SYSTEM

(75) Inventor: Bojji Rajaram, Navi Mumbai (IN)

(73) Assignee: Konkan Railway Corporation Ltd. (IN)

( * ) Notice: Subject to any disclaimer, the term of this patent is extended or adjusted under 35 U.S.C. 154(b) by 0 days.

(21) Appl. No.: 10/206,311

(22) Filed: Jul. 26, 2002

(65) Prior Publication Data

US 2003/0047106 A1 Mar. 13, 2003

(30) Foreign Application Priority Data

Jul. 26, 2001 (IN) ..... 715/01
Jul. 26, 2001 (IN) ..... 716/01
Jul. 26, 2001 (IN) ..... 717/01

(51) Int. Cl.[7] ..... B61B 3/00
(52) U.S. Cl. ..... 104/89
(58) Field of Search ..... 104/89, 91, 93, 104/23.2

(56) References Cited

U.S. PATENT DOCUMENTS 3,225,228 A * 12/1965 Roshala ..... 104/23.2
3,559,583 A * 2/1971 Chadenson ..... 104/89
3,774,542 A * 11/1973 Walsh ..... 104/89
3,847,085 A * 11/1974 Rypinski ..... 104/89

* cited by examiner

*Primary Examiner*—S. Joseph Morano
*Assistant Examiner*—Lars A. Olson
(74) *Attorney, Agent, or Firm*—Muserlian, Lucas and Mercanti

(57) ABSTRACT

A suspended transportation system comprising an extended continuous hollow box way having a slot throughout its operative under wall, said box way being elevated by columns from the ground level and generally following the lay of the ground; a pair of rails fixed on either side of the slot on the operative inner surface of the under wall within the extended box way and extending continuously throughout the box way; a plurality of bogie assemblies moving on the said rails within the box way secured to a floating beam located in the box way operative overhead of the bogie assemblies suspension means extending from the floating beams operatively downwards and through the slot in the box way; coaches suspended from suspension means; and motor means to displace the bogie assemblies on the rails. A derailment control safety device is also disclosed.

21 Claims, 10 Drawing Sheets

SUSPENDED COACH TRANSPORTATION SYSTEM

FIELD OF THE INVENTION

This invention relates to an elevated suspended transportation method and apparatus and devices therefor.

Particularly, this invention relates to a transportation system, and more particularly to a system of capable of providing high capacity suspended lateral transportation particularly, in downtown core areas.

PRIOR ART

Transportation is a critical element in the smooth and efficient operation of almost every aspect of today's cities and urban areas. All over the world, the population is rising and the infrastructure development is not keeping pace. Roads are unable to handle the rising number of vehicles and metro rails face inadequacies in increasing the capacity, besides there is also the concomitant risk of vandalism and derailment. Expansions or new construction need land in urban areas, which is not possible; alternative underground railways are too expensive. As a result, many types of transportation systems have been developed to move people and cargo from one place to another more efficiently. The most prominent transportation systems are overland travel by cars and bogies, both operating on roads such as public highways. Public buses utilize the same highway network, as do, to some extent, cable cars and electric buses. Conventional high capacity urban transportation systems generally employ underground trains or streetcars moving along conventional rails. Such systems take up a considerable amount of space in the urban area and do not allow the individual cars to be separately directed. Subways, monorails, and trains, however, utilize a rail network that is typically less developed than the surrounding highway networks. Other forms of inter-city transportation include the bicycle, auto rickshaws, scooters and motor cycles, all of which use the same roads. Consequently the roads are unable to handle the rising number of vehicles.

Public buses also utilize the highway network, but are far less popular than cars. Buses are less favored than cars because a passenger often has to wait at a bus stop for a relatively long period of time and in potentially disagreeable weather. Further, buses are generally restricted to particular routes, and consequently a bus rider must walk, or acquire other transportation, to and from bus stops along various routes proximate to his origination and destination. Frequently, transfers must be made from one bus to another due to inadequate routes, and frequent interim stops must be made to load or unload other passengers. Still further, buses are subject to many of the same drawbacks as the car, such as traffic, stop lights, and traffic risk. As a result, buses are not as popular as the car even though, when properly utilized, buses are more efficient and less environmentally harmful than the cumulative effect of so many individual cars.

Rail-guided vehicles, such as trains, monorails, metro-rails and subways, are an alternative transportation system found in many cities and urban areas. When properly utilized, such systems are more energy efficient than cars and less environmentally damaging. However, many of the same drawbacks exist for rail guided vehicles as for buses. For example, rail guided vehicle users are dependent upon predetermined and often inadequate schedules, a limited number of fixed routes, and lost time due to stops at intermediate stations for other passengers. Even the relatively high speeds attained by rail-guided vehicles do not fully compensate for the time lost in other ways when using such transportation systems. Surface railway is impossible to lay in an existing city. But even to lay the same in a new development is subject to negative implications. The development remains divided by the corridor and it a permanent noise polluter. Disgorging of heavy loads of commuters at stations creates needless congestion on the roads reducing the quality of life. Several thousands of persons die annually because of trespassing or failing from trains. In addition derailments, collisions and capsizing cause serious damage to life, limb and property.

Underground railway is less invasive on the surface but still poses technical challenges including the management of fires and evacuation. If road vehicles are involved in intermodal transfers, it becomes a weak link in the chain of transport between walking and the railway.

Elevated railway technically cannot reach congested central busy roads where mass transport is needed. It is too invasive and may require dislocation of some portions of the habitat as well as the system is very noisy.

Consequently, cities and urban areas have been plagued by the problems associated with having private cars as the primary mode of civilian transportation. A person will readily spend hours in heavy traffic either because there is no alternative, or because any available alternatives require more time and inconvenience. Moreover, the pollution created by millions of private cars is having a deleterious effect on the environment and quality of civilian life, not only in urban areas but in the surrounding rural areas as well. The cumulative energy wasted at traffic signals and in traffic is considerable, and causes a direct increase in fuel costs and other costs associated with vehicular transportation. The energy required to accelerate a car that weighs several thousand kilograms is frequently converted into little more than friction within the car's braking system at the next traffic light. This is a considerable amount of wasted energy since the average human occupant in a typical car represents a mere 5% of the gross vehicle weight. Still further, dependence upon extremely large amounts of gasoline or diesel to power a large automotive transportation system makes such a society somewhat vulnerable to the whims of those who possess these reserves.

Clearly, then, there is a need for a civilian transportation system that is able to compete with the car in terms of convenience to the user, but does not require the tremendous energy consumption of an automotive transportation system. Further, such an improved transportation system should provide increased safety expectations, less overall cost to the user, and profitability to those manufacturing, owning, and operating such a system. All administrations are in search of an economical viable solution to the transportation problem, which is concomitantly environment-friendly.

SUMMARY OF THE INVENTION

The present invention relates to a public transportation system that fulfills these needs and provides further related advantages. An object of the present invention is to provide a more versatile urban transportation system that has hitherto been impossible using systems of the prior art.

The present invention relates to a novel suspended coach rail transportation system.

Specifically, the present invention relates to a means of improving the running and the safety levels of suspended coach rail transportation systems and more specifically, methods, means and devices preventing capsizing of the coach and derailment of the bogie by external forces acting upon the bogie and to provide improved tractive capability.

Single supporting rail suspended monorail systems have been built in the past. The potential of high-speed operation requires that the attitude of the cars is securely controlled and capsizing of the coaches and derailment of the bogies carrying the cars be prevented.

OBJECTS OF THE INVENTION

The principal objective of the present invention is to provide a suspended coach transportation system that includes a bogie, that can operate inside a continuous box type elevated closed horizontal beam having a slot in lower surface for the traverse of a suspended coach supported by suspenders extending from the beam, that will eliminate the possibility of derailment of the bogie due to forces acting upon the bogie. A very high speed, 100 KMPH to 200 KMPH, can be obtained.

According to the present invention there is provided a suspended transportation system comprising an extended continuous hollow box way having a slot throughout its operative under wall, said box way being elevated by columns from the ground level and generally following the lay of the ground; a pair of rails fixed on either side of the slot on the operative inner surface of the under wall within the extended box way and extending continuously throughout the box way; a plurality of bogie assemblies moving on the said rails within the box way secured to a floating beam located in the box way operative overhead of the bogie assemblies suspension means extending from the floating beams operatively downwards and through the slot in the box way; removably mounted coaches suspended from suspension means; and motor means to displace the bogie assemblies on the rails.

Typically, the coaches are suspended in the by coach suspension means in a manner that permits controlled longitudinal, swinging and angular displacement of the coaches and their suspension means.

Typically, the box way is a concrete box way and an array of central columns support two extending box ways on either side of the columns permitting traverse of suspended coaches along the box ways on either side and alongside of the columns, typically in opposite directions.

In accordance with a preferred embodiment of this invention the box way has a generally rectangular or square cross section defined by a pair of horizontal and a pair of vertical walls typically of concrete said walls enclosing a space; one of said horizontal walls, typically the under wall of the box way defining a continuous slot.

Typically, the extended box way is constructed by aligning and joining a plurality of pre fabricated box way segments secured to the columns.

Typically, the box ways on either side of the columns are integral with each other.

In accordance with a preferred embodiment of the invention, the columns are typically 1 m-diameter columns 8 m high spaced apart by a distance of advantageously 15 m with respect to each other and formed in the divider space between the carriage ways on a roadway.

Typically the coaches are suspended at a height of 2 m to 4 m above the road surface/ground level.

Typically, the rails are fitted in an elastic medium dampened by inertia of measured mass.

In accordance with a typical embodiment of the invention the conventional rails used for over ground railways are used as the guiding rails in the box ways.

According to yet another feature of the invention an electric current delivering rail is fitted on one of the walls of the box way and running through its length. Typically an insulated wheel or other device will run against this power supplying rail effectively collecting current to power motors, preferably linear induction motors cooperating with the bogie assemblies.

Typically, a fourth continuous rail mounted on the inner surface of one of the walls of the box way is provided to cooperate with the linear induction motors associated with the bogie assemblies.

Typically in accordance with a preferred embodiment of this invention, the bogie is secured to a suspender beam via a connecting steel load transfer beam and spring loaded bolsters, to dampen the jerks and other movements from the rails to the bogie wheels. The bogies are also secured to the suspender beams via means of central pivots which permit controlled play and limited angular displacement of the bogie assembly on the suspender beam, if necessary.

The coaches are suspended from the suspender beam by a plurality of suspender shafts. The shafts, in accordance with a preferred embodiment of this invention, consist of a plurality of typically four, discreet wire ropes fitted between and spanning the suspender beam joint and the coach roof coupling.

The suspension shaft is secured to the suspension beam joint by means of cross pins which allow longitudinal motion of the shaft and the coaches suspended therefrom and at the same time the whole arrangement permits the coaches to swing in a controlled manner in an axis parallel to the direction of travel of the coaches.

The coaches are removably connected the suspension shafts, which permits fast and efficient removal and replacement of the coaches with other coaches or with load carrying. Cargo carrying means, if desired.

According to another aspect of the invention there is provided swing control means fitted to the novel suspended coach rail transportation system of this invention.

Specifically, the object of this aspect of the invention is to provide a means of improving the safety levels of suspended coach rail transportation systems and more specifically, methods, means and devices controlling the longitudinal swing of the coach and derailment of the bogie by external forces acting upon the bogie and to provide improved tractive capability.

According to this aspect of the present invention there is provided swing control means in suspension means for coaches in a transportation system consisting of an extended continuous hollow box way having a slot throughout its operative under wall, said box way being elevated by columns from the ground level and generally following the lay of the ground; a pair of rails fixed on either side of the slot on the operative inner surface of the under wall within the extended box way and extending continuously throughout the box way; a plurality of bogie assemblies moving on the said rails within the box way; said coaches being suspended from suspension means extending through the slot in the box way the bogie assemblies being generally connected to the coach suspension means in a manner that permits controlled longitudinal, swinging and angular displacement of the coaches and their suspension means, said swing control means which control the swinging of the coaches beyond a preset limit comprising a plurality of wheels mounted on a space frame swingably secured to the operative roof of the coaches and in the gap between the said roof and the under surface of the said box way, the wheel and frame assembly adapted to swing from a normally inoperative configuration in which the wheels are spaced apart from the under surface of the box way to an operative configuration in which the wheels abut and bear on the under surface of the box way to limit the swing of the coach.

The controlled swing means in accordance with this invention consist of a set of tyre wheels, typically spring loaded solid rubber tyre wheels fitted on a space frame mounted and spanning between adjacent suspension shafts such that the tyre wheels do not, in its normal operative configuration, touch the box way but in an abnormal operative configuration, if the swing of the coaches goes beyond a preset limit, the wheels will touch and abut the under wall of the box way take the reaction against the under wall of the box way, thereby preventing abnormal swinging.

According to another aspect of the invention, the invention relates to a derailment control safety device to be installed on the system in accordance with this invention.

Therefore another objective of the present invention is to provide in a suspended coach transportation system that includes a bogie, that can operate inside a continuous box type closed horizontal beam having a slot in lower surface for the traverse of the coach body support, that will eliminate the possibility of derailment of the bogie due to forces acting upon the bogie, with or without including devices for controlling excessive swing of the coaches in the stationary state or during motion at high, an improvement in that novel derailment arrester means is provided on the bogie assembly/coach suspension.

According to this aspect of the present invention there is provided a derailment arrester in a transportation system comprising an extended continuous hollow box way having a slot throughout its operative under wall, said box way being elevated by columns from the ground level and generally following the lay of the ground; a pair of rails fixed on either side of the slot on the operative inner surface of the under wall within the extended box way and extending continuously throughout the box way; a plurality of bogie assemblies moving on the said rails within the box way; removably mounted coaches suspended from suspension means extending through the slot in the box way the bogie assemblies being generally connected to the coach suspension means in a manner that permits controlled longitudinal, swinging and angular displacement of the coaches and their suspension means, said derailment arrester adapted to prevent the displacement of the bogie wheels from the guiding rails consisting of in combination flanges from the running surface of the bogie wheels extending below the outer surface of the rails and a plurality of additional wheels mounted in housings on the suspender beam causing the suspender beam and bogie assembly to bear on the rails to prevent derailment.

It is envisaged that the operation will be affected by air currents caused by movement of the coaches and surface winds. The forces from these air currents cannot be permitted to raise the light weight suspended coaches to the extent that the flanged bogie wheels can climb over the rails in the lateral direction.

It is therefore an objective of the present invention to provide a bogie that can exert a greater normal force on the running rails to increase the traction available to ascend or descend steeper gradients than can be safely ascended or descended relying on the force provided by the weight of the car and bogie assembly alone. This added tractive capability will permit steel wheel cars on steel rails to safely negotiate the gradients commonly encountered in major thoroughfares built for automobiles.

The second objective of increasing the gradability of the bogie is accomplished by using at least one auxiliary vertical wheel and actuator assembly against the under surface of the roof wall of the box way to create a downward force on the bogie and running wheels providing for additional traction between a smooth steel wheel on a smooth steel rail.

Typically two such wheels are used which are isolated by the rest of the suspension mechanism by means of spring loaded/hydraulic and or pneumatic linkages which typically act as shock absorbers in addition to providing the basic function of derailment arresters.

Thus an objective of the invention is to provide a transit system high slow speed automated people mover suspended coaches which uses at least one anti-derailment wheel as a vertically movable wheel to exert additional vertical reactive force on the two running rails.

Yet another objective of the invention is that the anti-derailment device used in accordance with this invention is also functional in the inhibiting of vibration caused by the natural frequency of the bogies and the rails being excited by wheel movement by dampening the vibration. Unattenuated vibration creates noise and causes metal fatigue in structures.

BRIEF DESCRIPTION OF THE ACCOMPANYING DRAWINGS

The invention will now be described with reference to the accompanying drawings, in which FIG. 1 shows a schematic sectional view of the arrangement for a suspended coach rail transportation system in accordance with this invention;

Figure 1:
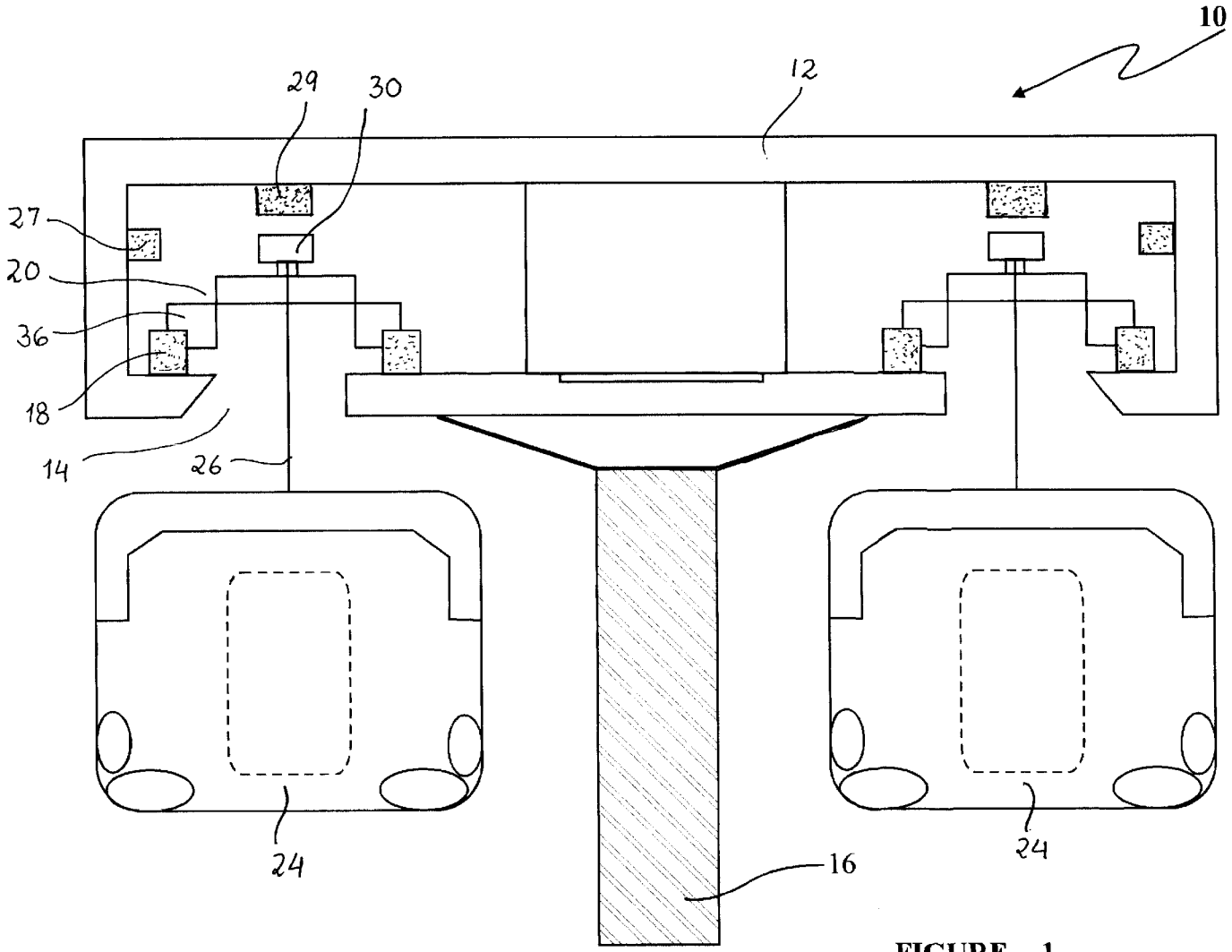
Figure 2:
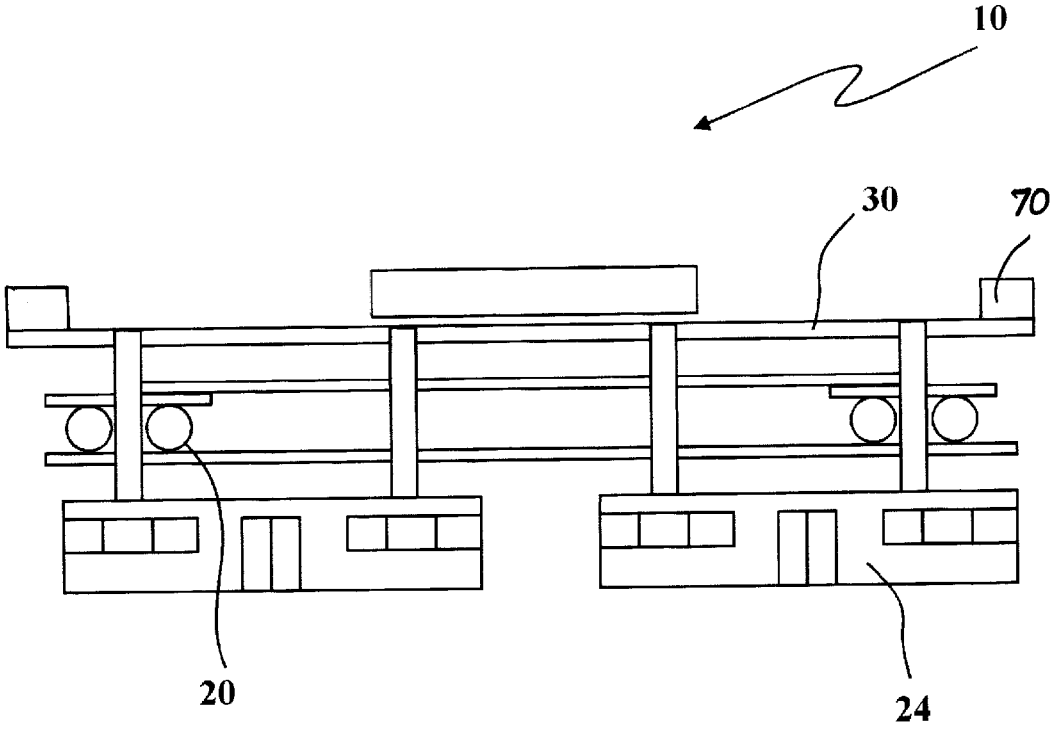
FIG. 2 shows a side schematic view of the suspended coach system of FIG. 1.
Figure 3A:
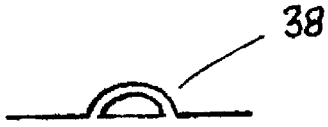
FIG. 3 shows schematic sectional view of the details of a bogie assembly fitted on the suspender beam.
Figure 3:
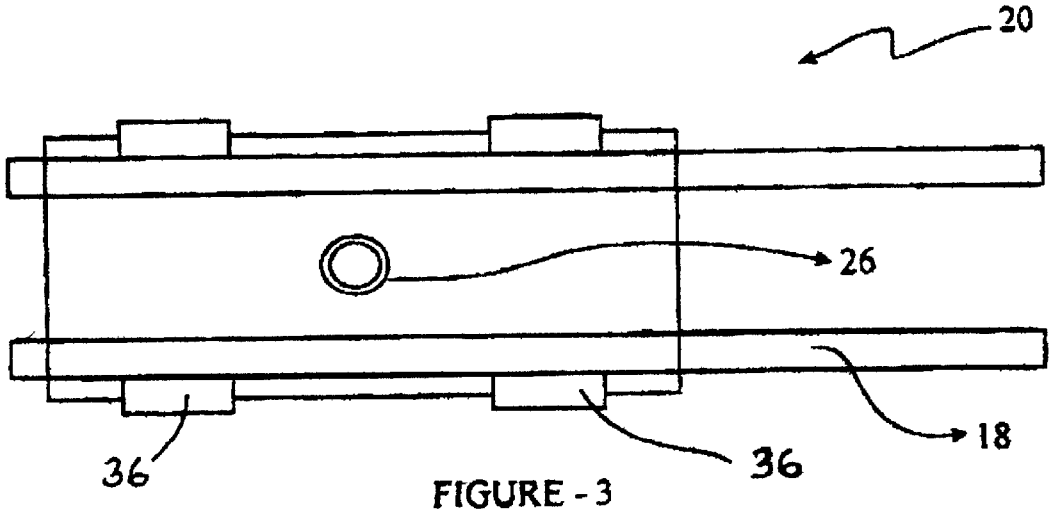
Figure 4:
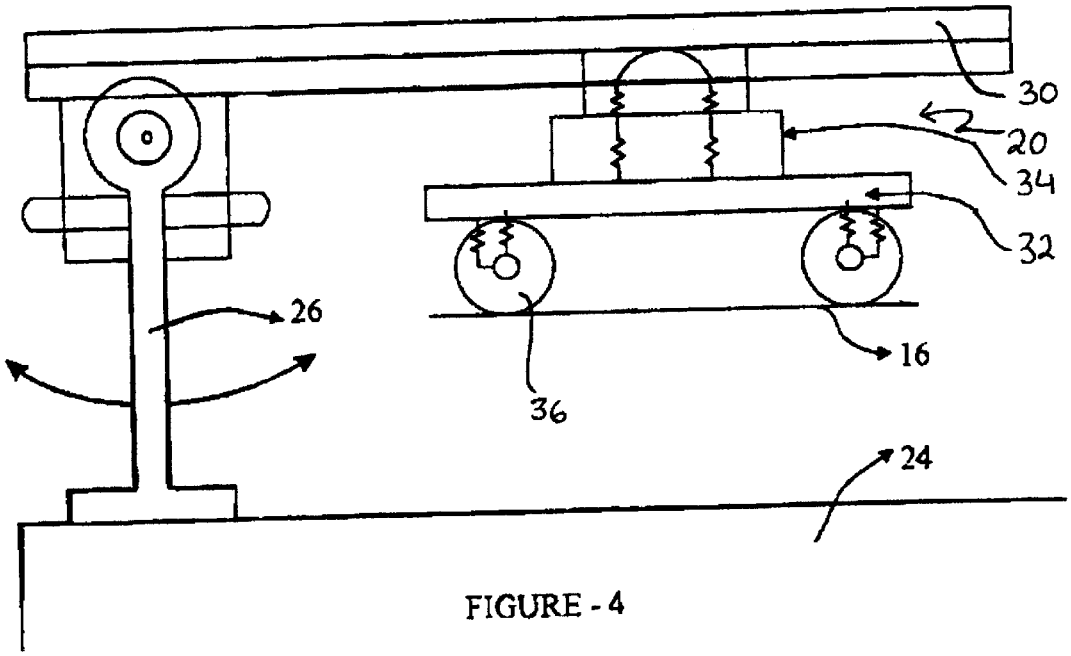
Figure 5:
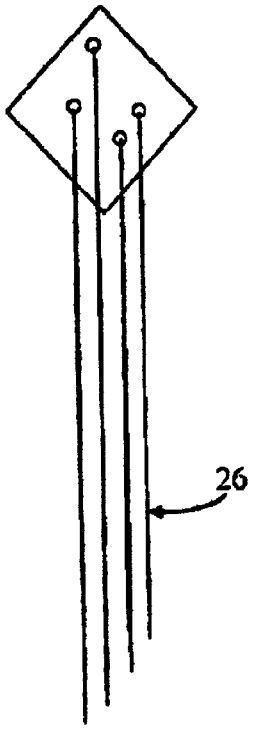
Figure 6:
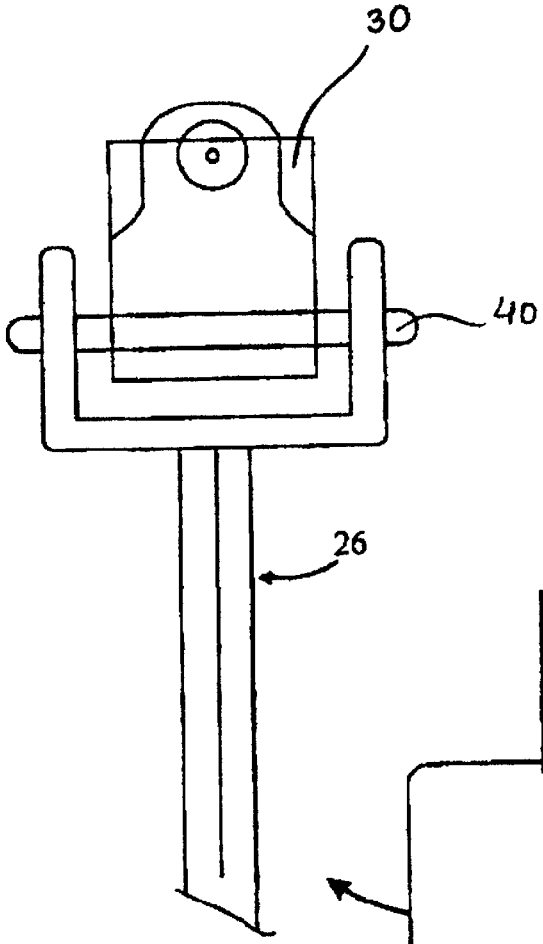
Figure 7:
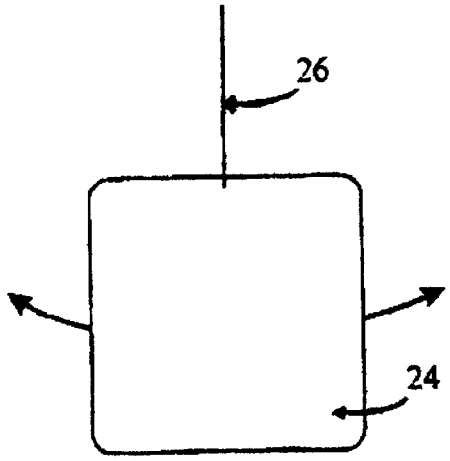
Figure 8:
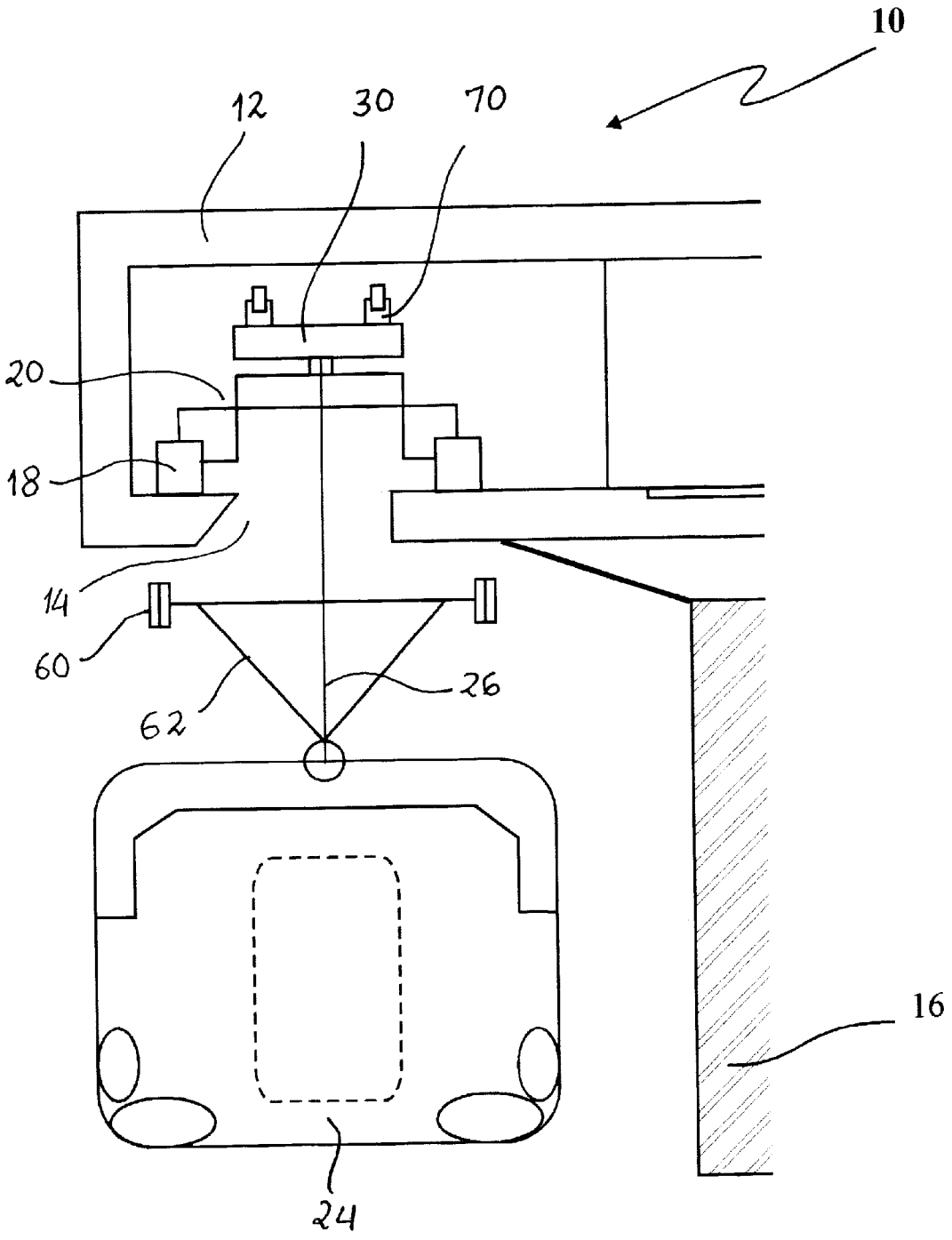
Figure 9:
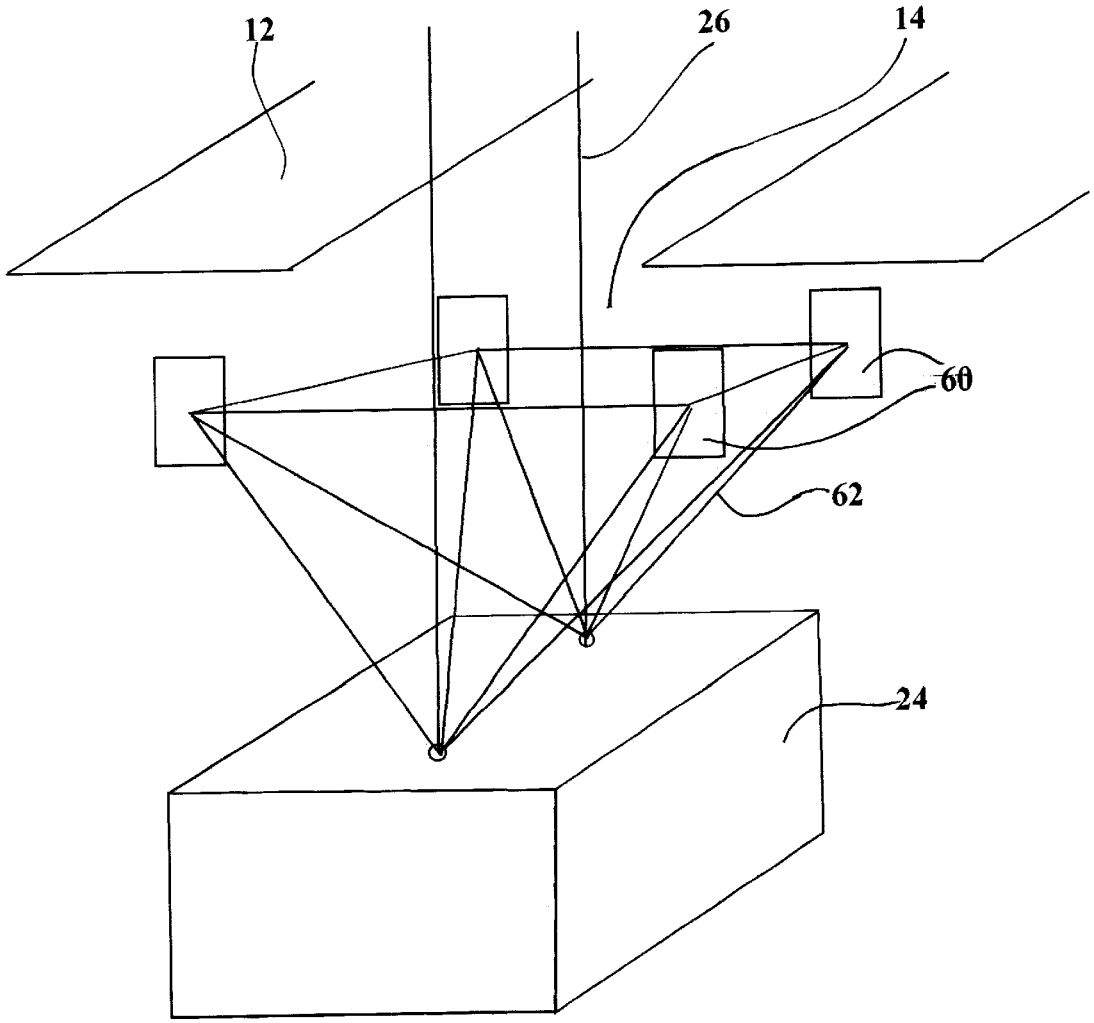
Figure 10:
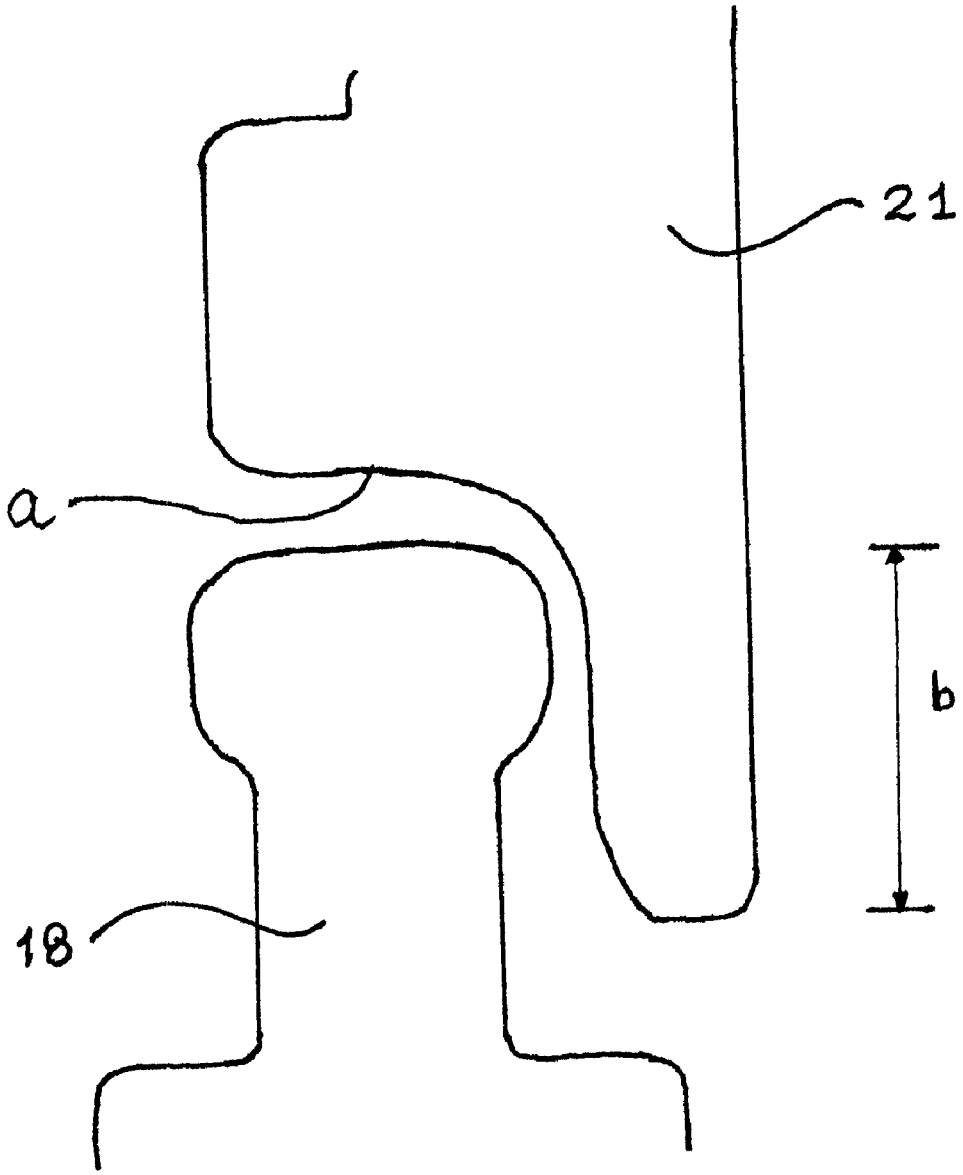
Figure 11:
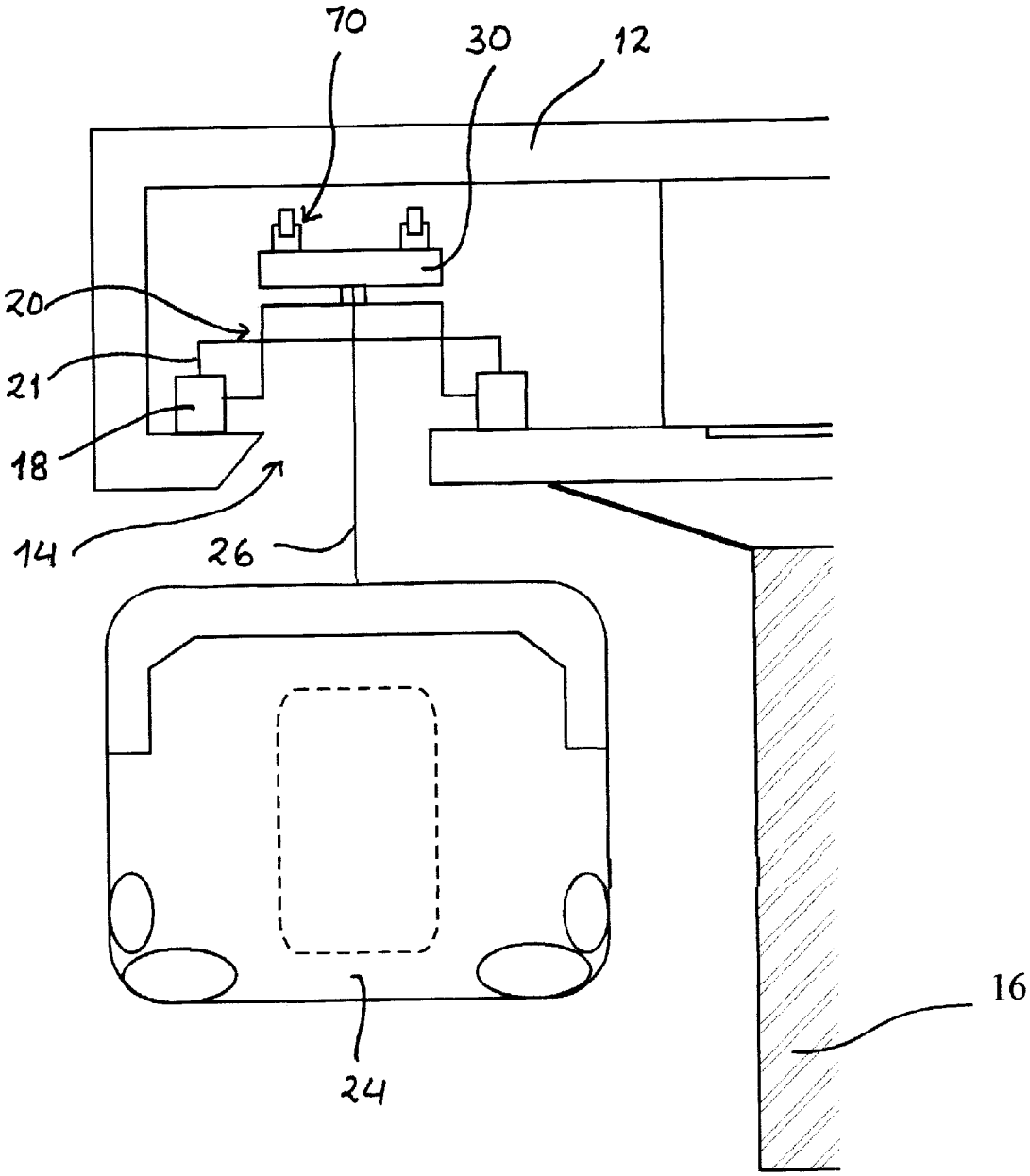

FIG. 3*a* shows details of the central pivot joint for the attachment arrangement shown in FIG. 3;

FIG. 4 shows the plan view of the bogie assembly partially showing the cooperation between the bogie assembly the suspender beam and the coach;

FIG. 5 shows details of the suspension shaft;

FIG. 6 shows details of the joint between the suspension shaft for the coach and the suspender beam;

FIG. 7 shows the controlled limited movements possible of the suspended coaches;

FIG. 8 shows schematic sectional view of the details of a swing control mechanism fitted on the suspension shaft of the system of FIG. 1;

FIG. 9 shows the schematic view of the space frame for the swing control mechanism shown in FIG. 8;

FIG. 10 is the schematic detailed view of the inter action between the steel rails and the steel wheels;

FIG. 11 shows the schematic sectional view of the the anti derailment device;.

Figure 12:
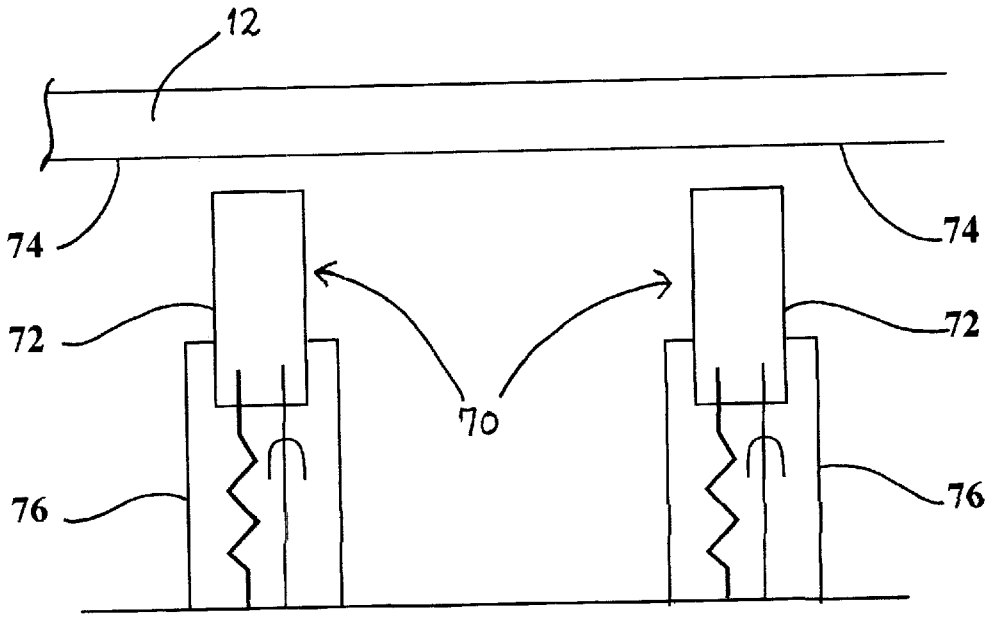
Figure 13:
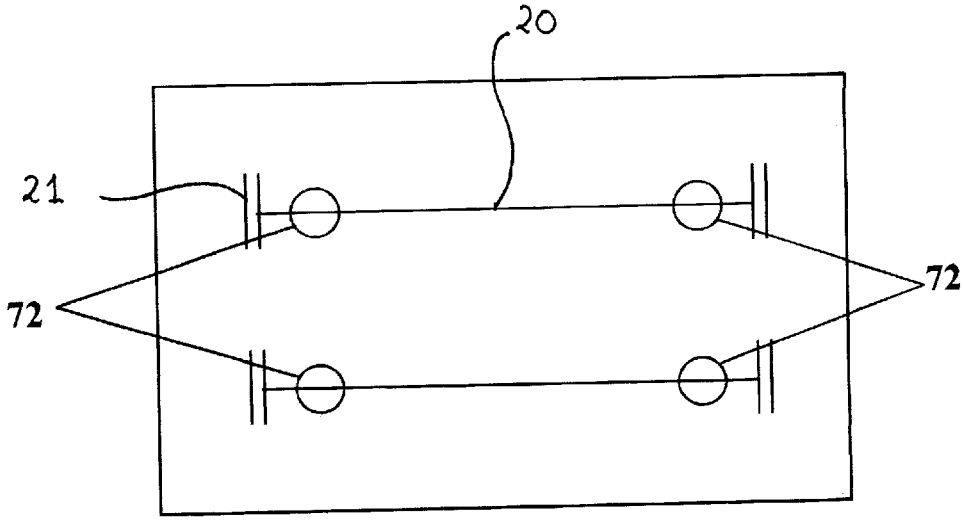

FIG. 12 shows the schematic sectional view of the details of the anti derailment device shown in FIG. 11;

FIG. 13 shows the plan view of the anti derailment device seen in FIG. 11.

DETAILED DESCRIPTION OF THE ACCOMPANYING DRAWINGS

Referring to the drawings, FIG. 1 shows a schematic sectional view of a suspended coach transportation system in accordance with this invention.

The transportation system generally indicated by the reference numeral 10 comprises an extended continuous hollow box way 12 having a slot 14 throughout its operative under wall. Columns 16 elevate the box way 10 from the ground level and generally following the lay of the ground. A pair of rails 18 are fixed on either side of the slot 14 on the operative inner surface of the under wall within the extended box way 12. The rails extend continuously throughout the box way. A plurality of bogie assemblies 20 move on the said rails 18 within the box way 12.

Removably mounted coaches 24 are suspended from suspension means 26 extending through the slot 14 in the box way 12. The bogie assemblies 20 are generally connected to the coach suspension means 26 in a manner that permits controlled longitudinal, swinging and angular displacement of the coaches 24 and their suspension means.

The box way 12 is a concrete box way and an array of central columns 16 support two extending box ways on either side of the columns as seen in FIG. 1. These box ways 12 permit traverse of suspended coaches along the box ways on either side and alongside of the columns, typically in opposite directions.

As seen in the Figures, the box way 12 has a generally rectangular or square cross section defined by a pair of horizontal and a pair of vertical walls typically of concrete said walls enclosing a space; one of said horizontal walls, typically the under wall of the box way defining a continuous slot 14.

The extended box way is constructed by aligning and joining a plurality of pre fabricated box way segments secured to the columns. The box ways on either side of the columns are integral with each other.

The columns 16 are typically 1 m-diameter columns 8 m high spaced apart by a distance of advantageously 15 m with respect to each other and formed in the divider space between the carriage ways on a roadway.

Typically the coaches 24 are suspended at a height of 2 m to 4 m above the road surface/ground level.

The rails 18 are fitted in an elastic medium dampened by inertia of measured mass.

Conventional rails used for over ground railways are used as the guiding rails in the box ways.

An electric current delivering rail 27 is fitted on one of the walls of the box way and running through its length. Typically an insulated wheel or other device[not shown] will run against this power supplying rail effectively collecting current to power motors, preferably linear induction motors cooperating with the bogie assemblies. A fourth continuous rail 28 mounted on the inner surface of one of the walls of the box way is provided to cooperate with the linear induction motors associated with the bogie assemblies 20 for providing control signals to the bogie assembly motor.

FIG. 3 shows a schematic sectional view of the details of a bogie assembly fitted on the suspender beam. FIG. 3*a* shows details of the central pivot joint for the attachment arrangement shown in FIG. 3. FIG. 4 shows the plan view of the bogie assembly partially showing the cooperation between the bogie assembly the suspender beam and the coach. FIG. 5 shows details of the suspension shaft. FIG. 6 shows details of the joint between the suspension shaft for the coach and the suspender beam. FIG. 6 shows the cross pin arrangement at the joint between the suspension shaft and the suspender beam and FIG. 7 shows the controlled limited movements possible of the suspended coaches.

The bogie assembly 20 is secured to a suspender beam 30 via a connecting steel load transfer beam 32 and spring loaded bolsters 34, to dampen the jerks and other movements from the rails to the bogie wheels 36. The bogies 20 are also secured to the suspender beams 30 via means of central pivots 38 as seen in FIG. 3*a*, which permit controlled play, and limited angular displacement of the bogie assembly 20 on the suspender beam 30, if necessary.

The coaches 24 are suspended from the suspender beam 30 by a plurality of suspender shafts 26. The shafts 26, in accordance with a preferred embodiment of this invention, consist of a plurality of typically four, discreet wire ropes as particularly seen in FIG. 5, fitted between and spanning the suspender beam joint and the coach roof coupling.

The suspension shaft is secured to the suspension beam 30 joint by means of cross pins 40 as seen in FIG. 6 which allow longitudinal motion of the shaft and the coaches suspended therefrom and at the same time the whole arrangement permits the coaches to swing in a controlled manner in an axis parallel to the direction of travel of the coaches.

The coaches are removably connected the suspension shafts, which permits fast and efficient removal and replacement of the coaches with other coaches or with load carrying. Cargo carrying means, if desired.

Thus the coaches are coupled to the bogie assemblies indirectly. The central pivot type coupling between the bogie assembly and the suspender beam provide controlled limited angular displacement represented by the movement arrows as seen in FIG. 4. The cross pin type coupling of the suspender shaft and the suspension beam as seen in FIGS. 6 and 7 permit longitudinal movement across the X-Y plane as seen in FIG. 7.

The coaches are preferably passenger cabins connected indirectly to the bogie assemblies by a rotational coupling that allows the passenger's cabin to remain in the vertical orientation while the attitude of the bogie changes as the direction of the track changes in the vertical direction.

The coach and bogie configuration is unique in its function of mobility, directional control, track interface, suspension, and flow extraction. The track system is also unique in its structural simplicity, universality of application in the transport sphere, and its passive operation. There are no moving track parts for any of the required switching operations.

The system can operate with a wide range of software trip control packages (headway, trip selection, and stops, individualized priority selection). In most applications the system can utilize proprietary programming software which includes a convoy-like flow. A module control and electronic and other services units block assembly 50 is fitted on the suspension beam.

In its preferred embodiment the system features unique self-propelled multi passenger quick entry/quick exit coaches, which can operate in several different track installations. The system can be rapid transit or normal transit type. This type of performance makes the system a true automated Personal Rapid Transit (PRT) system avoiding the use of signals, points, crossings and drivers. The self-propelled motion of the coaches can be totally microprocessor based Every new high-density development can provide a new expanded track network to the general public transit system. The self-propelled coaches can be made part of the publicly funded transit system; the track network is passive and virtually maintenance-free.

The market for the system reaches far beyond that of present-day elevated railway technology. The scope can quickly widen to fully-fledged transportation system applications, with increasing economies of scale. The market scope is further enhanced by the fact that the system can operate a variable mix of passenger coaches and freight cabins. With the flexibility of the various software packages, it is easy to operate an automatic goods-distribution system, together with the PRT coaches, on a common track network. A percentage of coaches (passenger and/or freight) can always be operated by the private sector, together with the majority of public transit coaches. New techniques of fare collection (taxes, magnetic cards, season cards, etc.) can preferably be introduced to match the high-efficiency operating characteristics of the system.

The system is a highly compact full-fledged transport system. Its compactness is a crucial economic factor in future transport planning considerations. Due to its unobtrusive scale and operational silence the system can be tightly integrated with existing facilities. It will be much easier and cheaper to establish this new multi-directional network space, which will largely disappear as part of the road carriageway. Present-day transport systems require very substantial right-of-ways and environmentally compromising support structure. Subways and underground railways can cost several crores per kilometer, mostly due to right-of-way costs. In contrast the system would have typical track installation at a fraction of the present day costs.

Advantages of the use of the system in accordance with this invention include the following: The system uses rugged technology of steel wheel on steel rail and uses the standard railway wheel sets and driving mechanism. The system can be adapted to any road alignment without disturbing other road traffic. Every minute passengers will get air-condition travel facility, covering distances at more than 45 km/h average speed at just 15 paise per km. Except for providing for right of way on existing roadways. Only at terminal points, minimum amount of land of the order of 2000 to 4000 sqm of area will be required—that too at places away from the urban centre. The system is not subject to Vandalism—Not vulnerable to persons throwing stones and track is inaccessible. No demolition of structures or gardens is necessary. No environmental hazards. Fire Protection—Fastest evacuation in case of fire as compared to underground metros No capsizing—If at all there is a derailment, the coach keeps hanging and does not fall down. Hence no capsizing takes place as compared to overground railways and underground metros No Run Over Accidents—In big metros like Mumbai, 2 to 3 deaths occur daily on the railway tracks, with total causalities reaching almost 500 to 600 per year. This is avoided in the transportation system in accordance with this invention. Deep Penetration—The track follows existing busy roads, thus reaching the very heart of the city while decongesting the roads Low Capital cost—almost 50% of elevated rail systems & 25% of underground metro for same performance standards Low Operational cost—Maintenance free tracks, no track circuits or signals, points & crossings to maintain. No interference with normal road traffic—Does not require road over/under bridges Fast Clearance—Since the system involves guide ways in the sky, which does not fall into an exact definition of Railway, the number of agencies involved in clearing and executing the project will be minimum and only one authority at the respective State level will be created for implementing the project. Capacity—Can handle 15,000 to 50,000 pphpd (persons per hour per direction) and can still cater to growing needs. Luxury—Clean and comfortable cafes, business centers, restaurants and communication facilities with health parks made available on sky-top.

FIG. 8 shows schematic sectional view of the details of a swing control mechanism fitted on the suspension shaft of the system of FIG. 1. FIG. 9 shows the schematic view of the space frame for the swing control mechanism shown in FIG. 8.

Referring to FIGS. 8 and 9, the controlled swing means in accordance with this invention is illustrated which consist of a set of tyre wheels 60, typically spring loaded solid rubber tyre wheels fitted on a space frame 62 mounted at the same fixture as the suspension means and spanning between adjacent suspension shafts such that the tyre wheels 60 do not, in its normal operative configuration, touch the box way 12 but in an abnormal operative configuration, if the swing of the coaches 24 goes beyond a preset limit, the wheels 60 will touch and abut the under wall of the box way 12 take the reaction against the under wall of the box way, thereby preventing abnormal swinging.

The coach and bogie configuration is unique in its function of mobility, directional control, track interface, suspension, and flow extraction. The swing control mechanism is also unique in its structural simplicity, universality of application in the transport sphere, and its passive operation. There are no moving parts for any of the required operations.

The invention will now be described with reference to FIGS. 10 to 13 of the accompanying drawings: FIG. 10 is the schematic detailed view of the inter action between the steel rails 18 and the steel wheels 21. FIG. 11 shows the schematic sectional view of the anti derailment device in accordance with this invention. FIG. 12 shows the schematic sectional view of the details of the anti derailment device shown in FIG. 11, and FIG. 13 shows the plan view of the anti derailment device seen in FIG. 10.

As seen in FIG. 10 the profile of the operating surface of the railway wheel is defined by a running surface 'a' and an adjacent flange 'b' typically 8 to 25 inches in length. In turn the running surface and the flange are defined by three standardized parameters: flange height flange thickness and rim thickness. Thus the Steel Wheel profile includes several sections. A flange section protrudes downward from the side of the train wheel and extends over the lateral side of the rail. A fillet [not shown] extends upward along a field side of the flange providing transition to a straight conical wheel tread section. The wheel tread section serves as the major load bearing surface that supports the train wheels on the rail. The art uses tread profile of two opposing wheel on one of two rails to steer. Two opposing wheels are a wheel set. The flange provides steering when rail curve exceeds capability of treads to steer without flange contact, which may cause derailment. Two main factors have to be considered when designing wheel profiles for use with railed devices. The first is the dynamic stability of the suspended coaches and bogie assembly at various speeds throughout its operating speed range. When in transit, a suspended coach train experiences lateral oscillations known as "hunting". Wheel hunting results in the wheels oscillating laterally back and forth between the wheel flanges. The maximum speed or critical speed of the bogie assembly is determined by the onset of unstable, undesirable wheel set hunting. For example, if the bogie assembly goes too fast, the force of the lateral oscillations will overcome the flange barrier and cause the bogie assembly to derail. Hunting is caused by the dynamics between the wheel tread profile and the rail. Increasing the slope of the wheel tread too fast toward flange increases forces causing hunting and, therefore, lowers the critical speed of the vehicle. Decreasing slope of wheel tread toward flange decreases steering forces, also lowering the critical hunting speed.

A second factor involved with stability is the ability of the suspended coach to negotiate track curves. This curving ability is determined primarily by the ability of the opposing wheels of a wheel sets to follow the track curves. Optimally, the wheel sets should perform a purely rolling motion in the track curves without any contact between the wheel flanges and the rails. This requires steering forces to be generated by the sloped wheel tread independently of the wheel flange permitting the wheel set to yaw or rotate about a vertical axis which may be through its center. Oscillation of steering forces happen around vertical axis through its center of gravity (mass). This oscillation is a metric space. The oscillation of wheel set results in hunting. The steering forces move the bogie assembly wheel sets into a more radial position with respect to the track curves, thus, increasing bogie assembly stability around curves.

A wheel set includes two opposite wheels that may be joined together by an axle. With a conical (straight taper) wheel tread [typically as shown in FIG. 10] the conicity remains virtually constant with lateral deflection of a wheel set relative to the rails. That is, straight taper wheel treads have a constant slope. In other words, the conicity of each wheel remains the same irrespective of whether the wheel set runs centrally on the track or is deflected closer to one rail. Increasing the conicity of the wheel tread improves the steering ability of the wheel set because of the increased steering force. However, increased conicity also increases the oscillation of the wheel set. Oscillation of wheel set results in hunting. Therefore, with regard to the conicity of wheel treads, there is a conflict between the requirement for hunting stability and increased speed and for good curving ability of the wheel sets.

FIG. 11 shows a general arrangement of the derailment arrester means 70 typically in the form of solid rubber wheels secured with spring loaded isolator means on the suspender beam 30. The typical arrangement scheme is seen in FIG. 12 showing the rubber wheels 72 fitted in the isolator spring loaded means 76 which may hydraulic, mechanical or pneumatic and in the form of shock absorbers. The gap 'c" between the wheels 72 and the inner surface 74 of the box way is critically set, characterized in that in the normal operation of the movement of the wheel set of the bogie assembly on the rails 18 the derailment arrester wheels 72 will not contact the inner surface 72. Contact will happen only when a turning moment is applied to the wheel set and a jumping of the wheels of the rails 18 is attempted. At this time the wheels 72 will bear on the surface 74 and in turn exert a reactive bearing force on the wheel set and typically the flange portion enforcing contact between the wheel set and the rails 18 and preventing and arresting derailment.

As seen in the plan view of FIG. 13 four derailment arrester means with their corresponding wheels 72 are fitted on each bogie assembly.

Although the invention has been described in terms of particular embodiments and applications, one of ordinary skill in the art, in light of this teaching, can generate additional embodiments and modifications without departing from the spirit of or exceeding the scope of the invention. Accordingly, it is to be understood that the drawings and descriptions herein are proffered by way of example to facilitate comprehension of the invention and should not be construed to limit the scope thereof.

We claim:

1. A suspended transportation system comprising an extended continuous hollow box way having a slot throughout its operative under wall, said box way being elevated by columns from the ground level and generally following the lay of the ground; a pair of rails fixed on either side of the slot on the operative inner surface of the under wall within the extended box way and extending continuously throughout the box way; a plurality of bogie assemblies moving on the said rails within the box way secured to a floating beam located in the box way operative overhead of the bogie assemblies suspension means extending from floating beams operatively downwards and through the slot in the box way; coaches suspended from suspension means; and motor means to displace the bogie assemblies on the rails wherein the rails are fitted in an elastic medium dampened by inertia of measured mass.

2. A suspended transportation system as claimed in claim 1, in which the box way is a concrete box way and an array of central columns support two extending box ways on either side of the columns permitting traverse of suspended coaches along the box ways on either side and alongside of the columns, in opposite directions.

3. A suspended transportation system as claimed in claim 1, in which the box way has a generally rectangular or square cross section defined by a pair of horizontal and a pair of vertical walls of concrete said walls enclosing a space; one of said horizontal walls, the under wall of the box way defining a continuous slot.

4. A suspended transportation system as claimed in claim 1, in which, the extended box way is constructed by aligning and joining a plurality of pre-fabricated box way segments secured to the columns.

5. A suspended transportation system as defined in claim 1, in which, box ways on either side of the columns are integral with each other.

6. A suspended transportation system as claimed in claim 1, in which, the columns are 1 m-diameter columns 8 m high spaced apart by a distance of advantageously 15 m with respect to each other and formed in the divider space between the carriageways on a roadway.

7. A suspended transportation system as claimed in claim 1, in which, the coaches are suspended at a height of 2 m to 4 m above the road surface/ground level.

8. A suspended transportation system as claimed in claim 1, in which, the coaches are suspended from a suspender beam by a plurality of suspender shafts consisting of a plurality of four, discreet wire ropes fitted between and spanning a suspender beam joint and the coach roof coupling the suspension shaft is secured to the suspension beam joint by means of cross pins which allow longitudinal motion of the shaft and the coaches suspended therefrom and at the same time the whole arrangement permits the coaches to swing in a controlled manner in an axis parallel to the direction of travel of the coaches.

9. A suspended transportation system as claimed in claim 1, in which, the coaches are removably connected to the suspension shafts, which permits fast and efficient removal and replacement of the coaches with other coaches or with load carrying cargo carrying means.

10. A suspended transportation system as claimed in claim 1, in which, an electric current delivering rail is fitted on one of the walls of the box way and running through its length and the bogie assemblies are provided with collector means for collecting power from the current delivering rail for operating the motor means.

11. A suspended transportation system as claimed in claim 1, in which, the collector means is an insulated wheel which runs against the current delivering rail effectively collecting current to power the motor means.

12. A suspended transportation system as claimed in claim 1, in which, the motor means consist of at least one linear induction motors cooperating with the bogie assemblies.

13. A suspended transportation system as claimed in claim 1, in which, a fourth continuous rail mounted on the inner surface of one of the walls of the box way is provided to cooperate with the linear induction motors associated with the bogie assemblies of providing remotely located control signals to the motors.

14. A suspended transportation system as claimed in claim 1, in which, the coaches are suspended from a suspender beam by coach suspension means in a manner that permits controlled longitudinal, swinging and angular displacement of the coaches and their suspension means.

15. A suspended transportation system as claimed in claim 1, in which, the bogie is secured to a floating suspender beam which consist of a connecting steel load transfer beam and the bogie assembly is connected to the transfer beam via spring loaded bolsters, to dampen the jerks and other movements from the rails to the bogie wheels.

16. A suspended transportation system as claimed in claim 1, in which, the connection between the bogie assembly and a suspender beam is central pivot which permit controlled play and limited angular displacement of the bogie assembly on the suspender beam.

17. A derailment arrester in a transportation system comprising an extended continuous hollow box way having a slot throughout its operative under wall, said box way being elevated by columns from the ground level and following the lay of the ground; a pair of rails fixed on either side of the slot on the operative inner surface of the under wall within the extended box way and extending continuously throughout the box way; a plurality of bogie assemblies moving on the said rails within the box way; removably mounted coaches suspended from suspension means extending through the slot in the box way the bogie assemblies being connected to the coach suspension means in a manner that permits controlled longitudinal, swinging and angular displacement of the coaches and their suspension means, said derailment arrester adapted to prevent the displacement of the bogie wheels from the guiding rails consisting of an combination flanges from the running surface of the bogie wheels extended below the outer surface of the rails and a plurality of additional wheels mounted on housings on a suspender beam causing the suspender beam and bogie assembly to bear on the rails to prevent derailment.

18. A derailment arrester in a transportation system as claimed in claim 17, in which the additional wheels are spring loaded.

19. A derailment arrester in a transportation system as defined in claim 17, in which additional wheels are solid rubber wheels.

20. A derailment arrester in a transportation system as claimed in claim 17, in which four additional wheels are provided adjacent to the corners of the suspender beam.

21. A derailment arrester in a transportation system as claimed in claim 17, in which the additional wheels are spaced apart from the under surface of the top wall of the concrete box way.

* * * * *